US006695600B2

(12) United States Patent
Koo et al.

(10) Patent No.: US 6,695,600 B2
(45) Date of Patent: Feb. 24, 2004

(54) SCROLL COMPRESSOR

(75) Inventors: In-Hwe Koo, Seongnam (KR); Yuong-Il Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/154,954

(22) Filed: May 28, 2002

(65) Prior Publication Data

US 2003/0223899 A1 Dec. 4, 2003

(51) Int. Cl.[7] ..... F04C 18/00
(52) U.S. Cl. ..... 418/55.5; 418/55.6; 418/57
(58) Field of Search ..... 418/55.5, 57, 55.6

(56) References Cited

U.S. PATENT DOCUMENTS 5,131,828 A * 7/1992 Richardson ..... 418/55.5
5,320,506 A * 6/1994 Fogt ..... 418/55.5
5,378,129 A * 1/1995 Dunaevsky et al. ..... 418/55.5
5,520,527 A * 5/1996 Kim ..... 418/55.5
5,588,819 A * 12/1996 Wallis ..... 418/55.5
6,086,335 A * 7/2000 Bass et al. ..... 418/55.5

FOREIGN PATENT DOCUMENTS

JP 04128582 A * 4/1992 ..... F04C/18/02

* cited by examiner

*Primary Examiner*—Thomas Denion
*Assistant Examiner*—Theresa Trieu
(74) *Attorney, Agent, or Firm*—Birch, Stewart, Kolasch & Birch, LLP

(57) ABSTRACT

A scroll compressor properly copes with a volume variation of a compressing chamber due to an inflow of an incompressible fluid by installing a radial moving apparatus between an eccentric part of a crankshaft and an orbiting scroll which enables the orbiting scroll to move radially so as to prevent the breakage of the scroll and improve a reliance of the compressor. The present invention includes a casing, a driving unit arranged at a lower side of the casing and connected to a crankshaft so as to generate a driving force, a compressing unit having an orbiting scroll eccentrically connected to the crankshaft and a fixed scroll to form a compressing chamber between the orbiting and fixed scrolls, and a compliance device installed between the compressing unit and the crankshaft for retreating the orbiting scroll in a radial direction when an incompressible material flows in the compressing chamber.

19 Claims, 8 Drawing Sheets

SCROLL COMPRESSOR

BACKGROUND OF THE INVENTION

1. Field of the Invention

The present invention relates to a scroll compressor enabling to prevent the breakage of a scroll by coping suitably with a volume variation working in a radial direction of a compressing chamber as well as improve a reliance of the compressor.

2. Background of the Related Art

Generally, a scroll compressor is an apparatus of compressing a fluid by varying a volume of a compressing chamber formed by a pair of scroll compressors. Compared to a reciprocating compressor or a rotary compressor, the scroll compressor has a high efficiency as well as a low noise. And, the light-weighted and small-sized scroll compressor can be manufactured, thereby enlarging its applied fields gradually.

FIG. 1 illustrates a cross-sectional view of a scroll compressor according to a related art, and FIG. 2 illustrates a magnified cross-sectional view of a part 'A' on FIG. 1.

Referring to FIG. 1, a scroll compressor according to a related art includes a casing 106 having a hermetic space wherein a suction pipe 102 sucking a fluid and a discharge pipe 104 discharging a compressed fluid are connected to an upper side and a lateral side, respectively, a driving unit 108 arranged at lower side of the casing 106 so as to generate a driving power, and a compressing unit 112 arranged at the upper side of the casing 106 and connected to the driving unit 108 and a crankshaft 110 so as to carry out a compression of a fluid.

The driving unit 108 includes a stator 114 fixed in a circumferential direction of the casing 106 and a rotor 116 arranged at an inner circumference face of the stator 114 so as to be fixed to the crankshaft 110. Once an electric power is applied to the stator 114, the crankshaft 110 revolves by a reciprocal reaction between the stator 114 and rotor 116.

The compressing unit 112 includes a fixed scroll 120 having an involute fixed wrap 118 and connected to the suction pipe 102 so as to be connected to the upper side of the casing 106 and an orbiting scroll 124 having an involute orbiting wrap 122 corresponding to the fixed wrap 118 so as to be connected to the crankshaft 110 eccentrically, wherein a uniform compressing chamber is provided between the fixed and orbiting scrolls 120 and 124.

The crankshaft 110 is supported by a main frame 128 fixed to the upper side of the casing 106 so as to revolve. An eccentric part 132 inserted in a boss 130 of the orbiting scroll 124 to make the orbiting scroll 124 circle round is formed at the upper side of the crankshaft 110. And, an oil flow path 134 is formed in a shaft direction so as to supply a frictional part between the orbiting scroll 124 and the eccentric part 132 with the oil filling the lower side of the casing 106.

A back pressure chamber 136 is formed between the main frame 128 and orbiting scroll 124 so as to forming a medium pressure between sucking and discharging pressures generated from inflow and outflow of the compressed fluid. And, an Oldham ring 138 is installed at a lower face of the orbiting scroll 124 so as to prevent the rotation of the orbiting scroll 124.

A seal ring 140 is inserted between the eccentric part 132 of the crankshaft 110 and the boss 130 of the orbiting scroll 124 so as to prevent the oil sucked through the oil flow path 134 from flowing out to the back pressure chamber 136.

Operation of the above-constructed scroll compressor according to a related art is explained as follows.

Once the electric power is applied to the driving unit 108, the crankshaft 110 connected to the rotor 116 starts revolving. And, the eccentric part 132 revolves so as to make the orbiting scroll 124 circle round. The fluid having flowed in the compressing chamber 126 through the suction pipe 102 moves to be compressed to a central part of the compressing chamber 126 by the circling movement of the orbiting scroll 124, and then the compressed fluid is discharged inside the casing 106 through a discharge outlet 142. The fluid discharged through the discharge outlet 142 at high pressure is discharged externally through the discharge pipe 104 connected to the lateral side of the casing 106.

When the fluid discharged inside the casing 106 at the high pressure pressurizes the oil stored in the lower side of the casing 106, the pressurized oil is supplied between the boss 130 of the orbiting scroll 124 and the eccentric part 132 along the oil flow path 134 so as to carry out a lubrication as well as pressurizes the orbiting scroll 124 upward so as to maintain a close adherence between the orbiting and fixed wraps 112 and 118.

In this case, a cross-sectional area of the eccentric part 132 is made to be equal to that of the crankshaft 110 so that there occurs no load in a shaft direction. Namely, a pressure of the oil pressurizing the eccentric part 132 downward is equal to that of the fluid pressurizing the crankshaft 110 upward, thereby the load fails to work on the crankshaft 110 in the shaft direction.

Unfortunately, the above-explained scroll compressor according to the related art has the crankshaft and eccentric part of which cross-sectional areas are equal to each other as well as the orbiting scroll fails to move in a radial direction. When a incompressible fluid such as a liquefied refrigerant, oil or particles flows in the compressing chamber so as to increase an inner pressure of the compressing chamber abnormally, a volume of the compressing chamber fails to vary in the radial direction. Therefore, the orbiting and fixed wraps of the orbiting and fixed scrolls are broken as well as a torsion stress is concentrated on the driving unit or crankshaft.

SUMMARY OF THE INVENTION

Accordingly, the present invention is directed to a scroll compressor that substantially obviates one or more problems due to limitations and disadvantages of the related art.

An object of the present invention is to provide a scroll compressor coping properly with a volume variation of a compressing chamber due to an inflow of an incompressible fluid or the like by installing a radial moving apparatus enabling an orbiting scroll to move radially between an eccentric part of a crankshaft and the orbiting scroll so as to prevent the breakage of the scroll and improve a reliance of the compressor.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a scroll compressor according to the present invention includes a casing having a high pressure inside, a driving unit arranged at a lower side of the casing and connected to a crankshaft so as to generate a driving force, a compressing unit having an orbiting scroll connected to the crankshaft eccentrically and a fixed scroll so as forming a compressing chamber between the orbiting and fixed scrolls, and a compliance means for retreating the orbiting scroll in a radial direction when an incompressible material flows in the compressing chamber, the compliance means installed between the compressing unit and the crankshaft.

Preferably, an oil flow path is formed to penetrate the crankshaft in a length direction and an eccentric part is formed at an upper side of the crankshaft so a to have a cross-sectional area smaller than that of the crankshaft.

More preferably, the compliance means is a compliance member inserted in an inner circumference face of a boss formed at a lower face of the orbiting scroll so as to revolve, a slot penetrates a center of the compliance member, and the eccentric part of the crankshaft is inserted in the slot so as to slide to move.

More preferably, the eccentric part extends from an upper side of the crankshaft so as to form a predetermined step part and has a straight portion provided by cutting both sides of the eccentric part 16 in a length direction.

More preferably, the slot is formed to have a predetermined length in a long direction so that the straight portion of the eccentric part is inserted in the slot to slide and the eccentric part slides to move in a radial direction to a predetermined distance.

More preferably, a seal ring is installed between an outer circumference face of the compliance member and the inner circumference face of the boss of the orbiting scroll.

More preferably, a cross-sectional area of the crankshaft is equal to an outer diameter area of the compliance member.

More preferably, a flange unit protrudes from an upper face of the crankshaft to a predetermined width in an external direction.

More preferably, a rib is formed in an outer circumferential direction of a lower face of the compliance member so as to adhere closely to an upper face of the crankshaft.

More preferably, a rib is formed in an inner circumferential direction of a lower face of the compliance member so as to adhere closely to an upper face of the crankshaft.

More preferably, a sealing member is inserted between a lower face of the compliance member and an upper face of the crankshaft.

More preferably, a fitting groove is formed at the lower face of the compliance member in a circumferential direction so that the sealing member fits in the fitting groove.

More preferably, a fitting groove is formed at the upper face of the crankshaft in a circumferential direction so that the sealing member fits in the fitting groove.

More preferably, the sealing member is formed of a Teflon based material.

More preferably, an elastic body is connected between an inner circumference face of the compliance member and an outer circumference face of the eccentric part of the crankshaft.

More preferably, the elastic body is a coil spring.

Preferably, the compliance means is a compliance member inserted in a boss formed at a lower face of the orbiting scroll to revolve and having an eccentric hole formed eccentric from a center so that an eccentric part of the crankshaft is inserted in the eccentric hole.

More preferably, the eccentric part is cylindrical so as to extend from an upper face of the crankshaft.

More preferably, the compliance member is cylindrical so as to be inserted in an inner circumference face of the boss and wherein an eccentric hole is formed at a location eccentric from a center of the compliance member to a predetermined extent.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
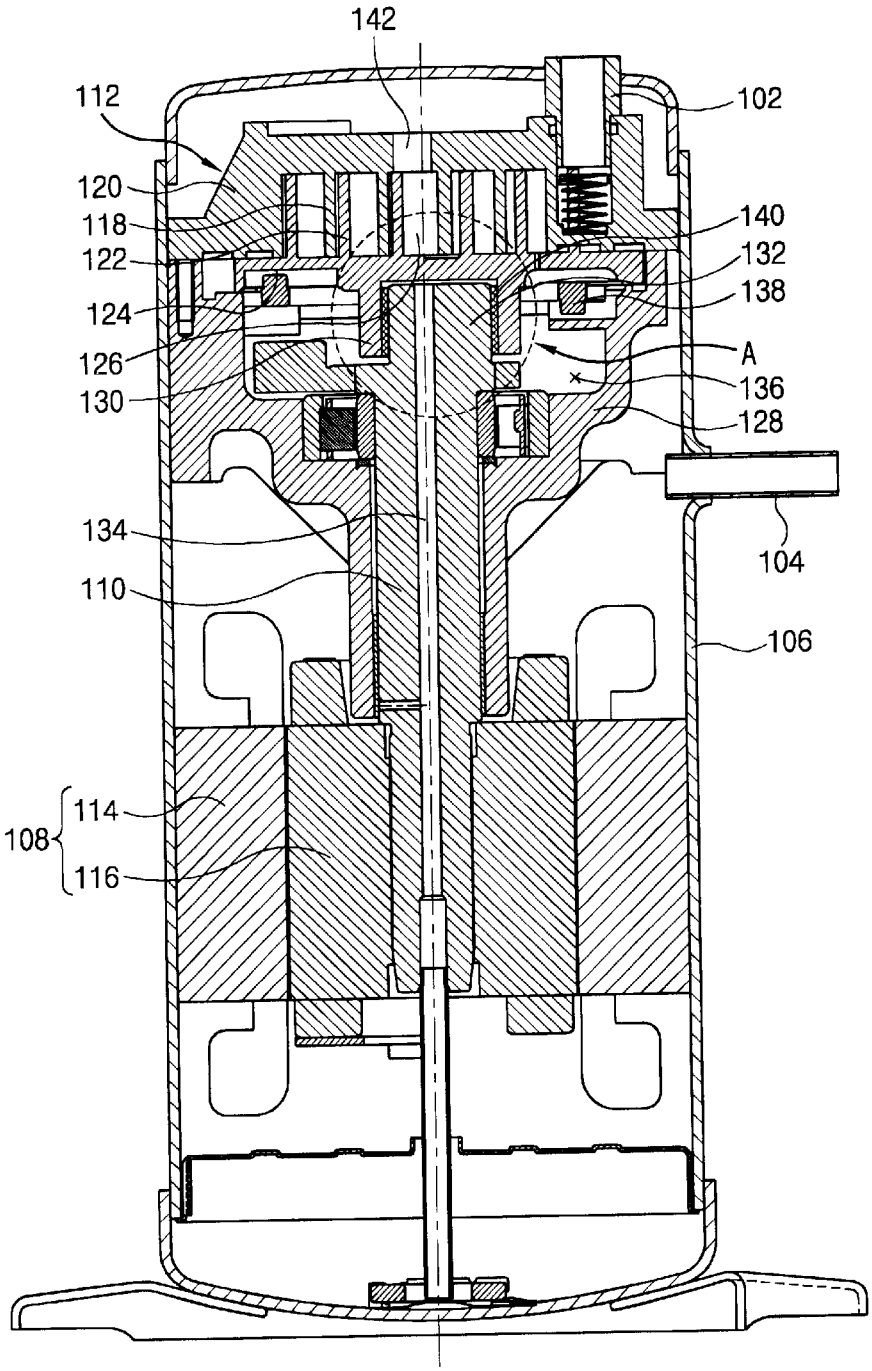
FIG.1 CONVENTIONAL ART
FIG. 1 illustrates a cross-sectional view of a scroll compressor according to a related art.
Figure 2:
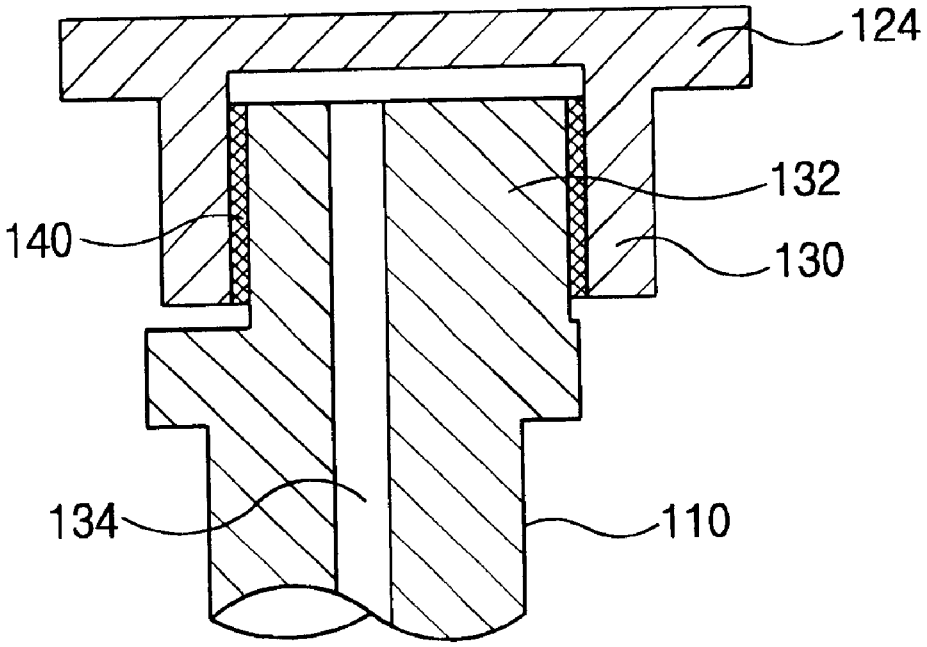
FIG. 2 CONVENTIONAL ART
FIG. 2 illustrates a magnified cross-sectional view of a part 'A' on FIG. 1.
Figure 3:
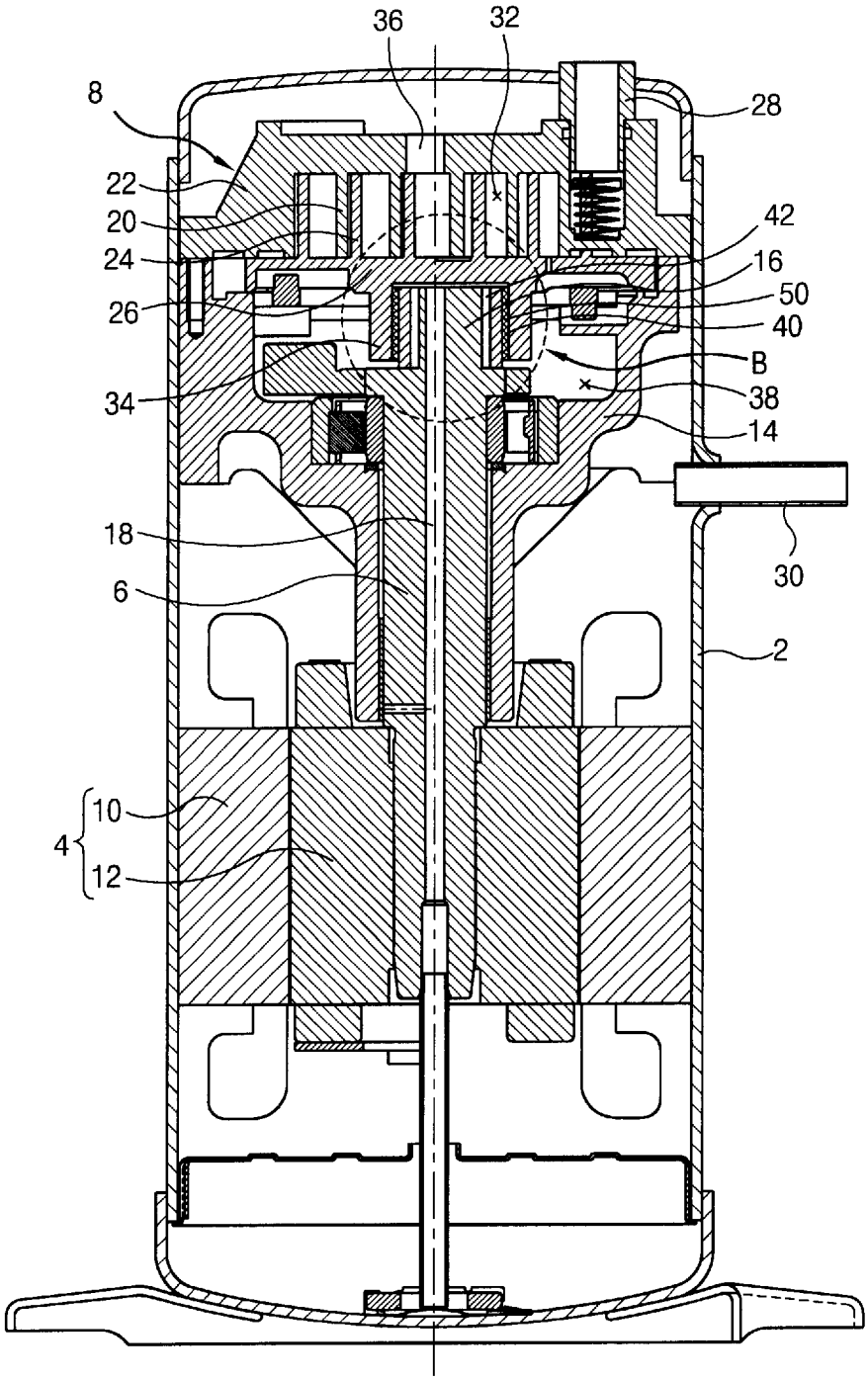
FIG. 3 illustrates a cross-sectional view of a scroll compressor according to a first embodiment of the present invention.
Figure 4:
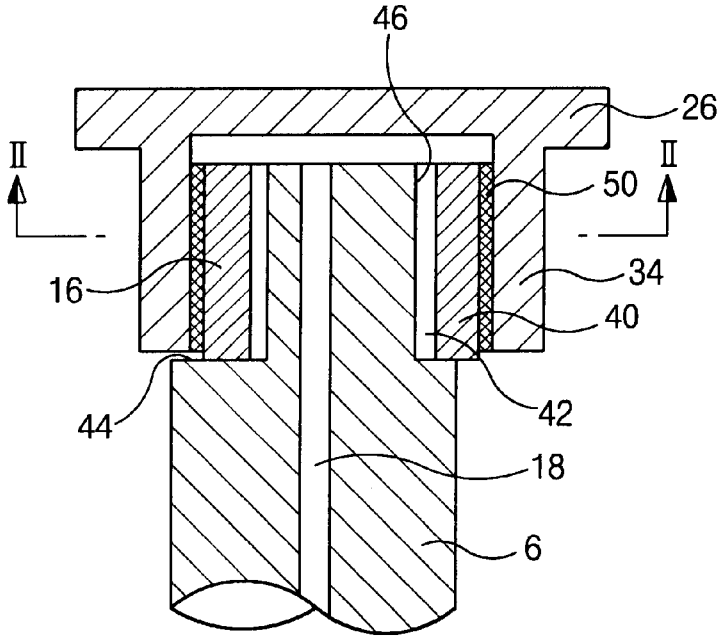
FIG. 4 illustrates a magnified cross-sectional view of a part 'B' on FIG. 3 according to the first embodiment of the present invention.
Figure 5:
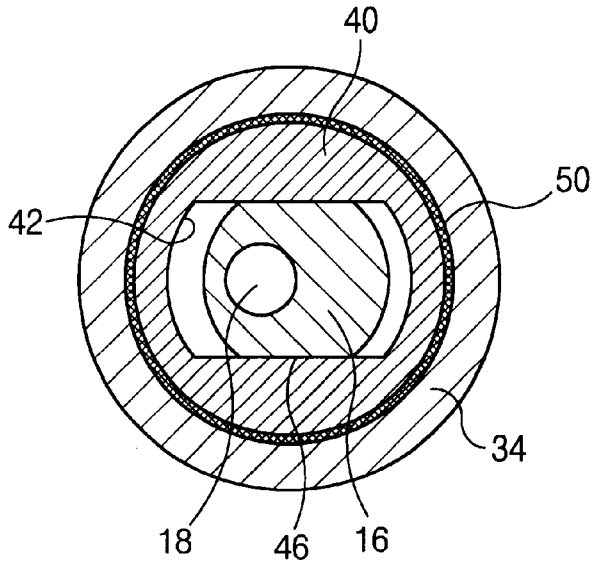
FIG. 5 illustrates a cross-sectional view along a cutting line II—II in FIG. 4 according to the first embodiment of the present invention.

FIG. 3 illustrates a cross-sectional view of a scroll compressor according to a first embodiment of the present invention, FIG. 4 illustrates a magnified cross-sectional view of a part 'B' on FIG. 3 according to the first embodiment of the present invention, and FIG. 5 illustrates a cross-sectional view along a cutting line II—II in FIG. 4 according to the first embodiment of the present invention.

Referring to FIG. 3 to FIG. 5, a scroll compressor according to the present invention includes a casing 2 having a high pressure inside, a driving unit 4 arranged at lower side of the casing 2 so as to generate a driving power, and a compressing unit 8 connected to the driving unit 108 and a crankshaft 110 so as to carry out a compression of a fluid.

The casing 2 is a hermetic vessel in which the high pressure is formed, in which a suction pipe 28 sucking the fluid and a discharge pipe 130 discharging the compressed fluid are connected to an upper side and a lateral side, respectively, The driving unit 4 includes a stator 10 fixed in a circumferential direction of the casing 2 and a rotor 12 arranged at an inner circumference face of the stator 10 so as to be fixed to the crankshaft 6. Once an electric power is applied to the stator 10, the crankshaft 6 revolves by a reciprocal reaction between the stator 10 and rotor 12.

The crankshaft 6 is supported by a main frame 14 fixed to an inside of the casing 2 so as to revolve. An eccentric part 16 is formed at an upper side of the crankshaft 6. And, an oil flow path 18 penetrates the crankshaft 6 so as to supply a sliding part inside the compressor with the oil stored in the lower side of the casing 2.

The compressing unit 8 includes a fixed scroll 22 having an involute fixed wrap 20 and fixed to an inside of the casing 2 wherein the suction pipe 28 is connected to one side of the fixed scroll 22 and an orbiting scroll 26 having an involute orbiting wrap 24 corresponding to the fixed wrap 20 and a boss 34 in which the eccentric part 16 of the crankshaft 6 is inserted.

A discharge hole 36 is formed at a central part of the fixed scroll 22 so as to discharge the fluid, which is compressed by a volume variation of the compressing chamber 32 between the fixed and orbiting wraps 20 and 24, inside the casing 2. A back pressure chamber 38 is formed in a space between the main frame 14 and orbiting scroll 26 so as to maintain about a medium pressure between sucking and discharging pressures generated from inflow and outflow of the fluid in the compressing chamber 32.

A compliance member 40 is arranged between an inner circumference face of the boss 34 of the orbiting scroll 26 and an outer circumference face of the eccentric part 16 of the crankshaft 6 so as to enable the orbiting scroll 26 to retreat back in a radial direction if an incompressible fluid such as a liquid refrigerant, oil or particles flows in the compressing chamber 32.

The compliance member 40 is inserted in the inner circumference face of the boss 34 of the orbiting scroll 26 so as to rotate. And, a slot 42, in which the eccentric part 16 of the crankshaft 6 slides in, is formed so as to penetrate the compliance member 40.

In this case, the eccentric part 16 of the crankshaft 6 extends from an upper face of the crankshaft 6 so as to have a cross-sectional area smaller than that of the crankshaft 6, and has a straight-line part 46 of which both sides are bisected in a length direction. A step part 44 is formed at the upper face of the crankshaft 6 at a portion from which the eccentric part 16 extends in a circumferential direction.

Both sides of the slot 42 of the compliance member 40 are straight-lined so as to move straight along the eccentric part 16. And, the slot 42 has a length sufficient to compensate a displacement of the orbiting scroll 26 retreating back in a radial direction.

An upper face of the compliance member 40 has a height equal to that of the eccentric part 16, and a lower face of the compliance part 40 adheres closely to the step part 44 of the crankshaft 6. Namely, the oil sucked in through the oil flow path 18 presses the compliance member 40 downward, and the pressure of the oil pressing the compliance member 40 maintains the state that the lower face of the compliance member 40 adheres closely to the step part 44 of the crankshaft 6. Thus, the oil supplied through the oil flow path 18 is prevented from leaking in the back pressure chamber 38.

A bearing member having a sealing capacity is inserted between an outer circumference face of the compliance member 40 and an inner circumference face of the boss 34 of the orbiting scroll 26, thereby enabling to prevent the oil from leaking between the boss 34 and compliance member 40.

In this case, a cross-sectional area of the crankshaft 6 is formed to be equal to an outer diameter area of the compliance member 40 so that a load fails to work on the crankshaft 6 in a shaft direction. Namely, a force pushing upward the crankshaft 6 by the highly pressurized fluid working inside the casing 2 is cancelled out by the other force pressing downward the eccentric part 16 and compliance member 40 by the pressure of the oil discharged through the oil flow path 18, thereby preventing the load from working on the crankshaft 6 in the shaft direction.

Operation of the above-constructed scroll compressor according to the present invention is explained as follows.

Once an electric power is applied to the driving unit 4, the crankshaft 6 starts revolving together with the rotor 12. When the eccentric part 16 rotates as being eccentric, the compliance member 40, which is installed at the eccentric part 16 to be movable in the shaft direction, revolves as well. In accordance with the revolution of the compliance member 40, the orbiting scroll 26 circles round. When the orbiting scroll 26 circles round, the fluid sucked in the compressing chamber 32 through the suction pipe 28 becomes compressed by the volume variation between the orbiting and fixed wraps 24 and 20 so as to be discharged inside the casing 2 through the discharge hole 30. The fluid having been discharged inside the casing 2 is then discharged outside through the discharge pipe 30. In this case, the compliance member 40 is moved by a centrifugal force of the eccentric part 16 along the straight line part 46 of the eccentric part 16 in a centrifugal direction, so as to maintain uniformly a gap between the orbiting and fixed wraps 24 and 20.

When the highly pressurized fluid discharged inside the casing 2 pressurizes the oil stored in the lower side of the casing 2, the oil 18 follows the oil flow path 18 so as to be discharged to the upper side of the eccentric part 16 to carry out lubrication on the sliding part. In this case, the pressure of the discharged oil is equal to that of the fluid.

And, the highly pressurized oil discharged to the upper face of the eccentric part 16 works on the upper faces of the eccentric part 16 and compliance member 40 so as to press the eccentric part 16 and compliance member 40 downward. In this case, the pressure of the fluid is working inside the casing 2. If the crankshaft 6 is pressurized upward, the force pressing the eccentric part 16 and compliance member 40 and the other force pushing the crankshaft 6 are cancelled out each other so as to prevent the shaft-directional force from working on the crankshaft 6.

Namely, a sum of the cross-sectional areas of the eccentric part 16 and the compliance member 40 is equal to the cross-sectional area of the crankshaft 6, and the pressure of the oil is equal to that of the fluid. Hence, the upward and downward loads working on the crankshaft 6 are equal to each other, whereby the crankshaft 6 is free from the shaft-directional force.

Therefore, the compliance member 40 comes into close adherence to the step part 44 of the crankshaft 6 by the downward force of the oil pressure, thereby preventing the oil leakage between the compliance member 40 and eccentric part 16. Moreover, the seal ring 50 inserted between the compliance member 40 and boss 34 prevents the other oil leakage between the compliance member 40 and boss 34.

When an incompressible material such as a liquid refrigerant, oil, or particles flows in the compressing chamber 32 during the normal operation of the compressor, a volume variation of the compressing chamber 32 occurs as soon as the orbiting scroll 26 retreats back in a radial direction so as to correspond to the volume variation of the compressing chamber 34.

Namely, if the pressure working on the compressing chamber 34 increases to exceed a normal value by the inflow of the incompressible fluid, a retreating force is exerted on the orbiting scroll 26 in a radial direction. At this moment, the slot 42 of the compliance member 40 moves to slide in a radial direction of the eccentric part 16, thereby enabling the orbiting scroll 26 to move in the radial direction.

Figure 6:
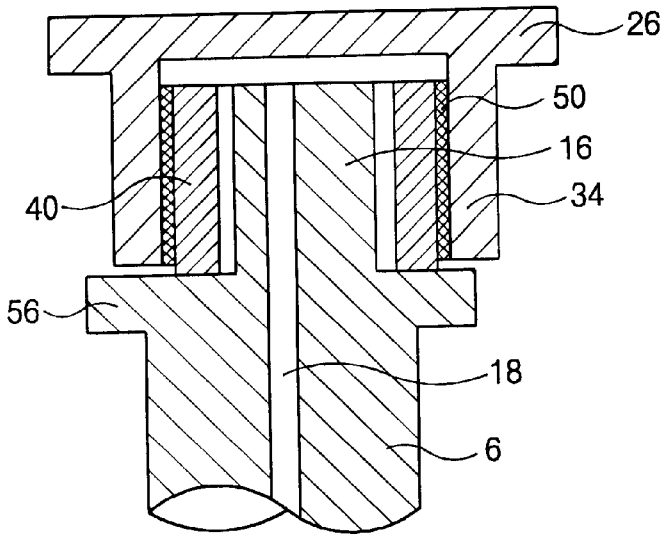
FIG. 6 illustrates a magnified cross-sectional view of a part 'B' on FIG. 3 according to a second embodiment of the present invention.

FIG. 6 illustrates a magnified cross-sectional view of a part 'B' on FIG. 3 according to a second embodiment of the present invention.

Referring to FIG. 6, a scroll compressor according to a second embodiment of the present invention has a structure that a flange unit 56 is formed to protrude to a predetermined width in an external direction of a portion from which the eccentric part 16 of the crankshaft 16 extends. Namely, the lower face of the compliance member 40 is contacted with the flange unit 56 to increase a contact area of the compliance member 40, thereby enabling to prevent the oil leakage more effectively.

Figure 7:
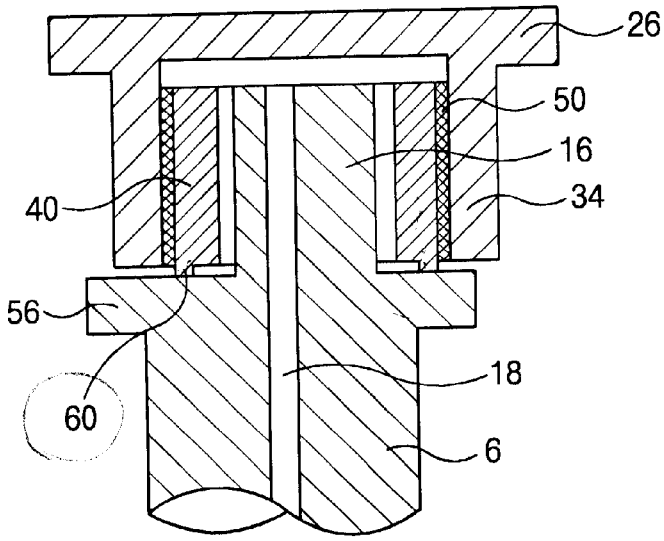
FIG. 7 illustrates a magnified cross-sectional view of a part 'B' on FIG. 3 according to a third embodiment of the present invention.

FIG. 7 illustrates a magnified cross-sectional view of a part 'B' on FIG. 3 according to a third embodiment of the present invention.

Referring to FIG. 7, a scroll compressor according to a second embodiment of the present invention has a structure that a rib 60 is formed to protrude to a predetermined width in an outer circumferential direction of the lower face of the compliance member 40 contacted with the flange unit 56 of the crankshaft 6.

Namely, for sealing, the lower face of the compliance member 40 should be contacted with the upper face of the flange unit 56, thereby requiring a precision grinding work. Yet, when the upper face of the flange unit 56 is grinded, the corresponding work time is elongated by the interference of the eccentric part 16 as well as the precision work gets difficult. Hence, the rib 60 is made to protrude from the lower face of the compliance member 40 in an outer circumferential direction, whereby a portion of the upper face of the flange unit 56 contacted with the rib 60 undergoes the precision grinding work only. Therefore, the work time is reduced as well as the precision work of the grinded face is performed easily.

Figure 8:
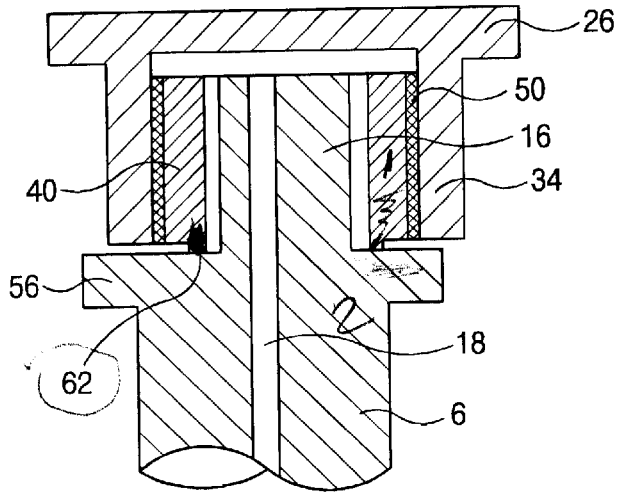
FIG. 8 illustrates a magnified cross-sectional view of a part 'B' on FIG. 3 according to a fourth embodiment of the present invention.

FIG. 8 illustrates a magnified cross-sectional view of a part 'B' on FIG. 3 according to a fourth embodiment of the present invention.

Referring to FIG. 8, a scroll compressor according to a fourth embodiment of the present invention has a structure that a rib 62 is formed to protrude to a predetermined width in an inner circumferential direction of the lower face of the compliance member 40 coming into contact with the flange of the crankshaft 6. Therefore, a scroll compressor according to the fourth embodiment of the present invention brings about the same effect of the scroll compressor according to the third embodiment of the present invention.

Figure 9:
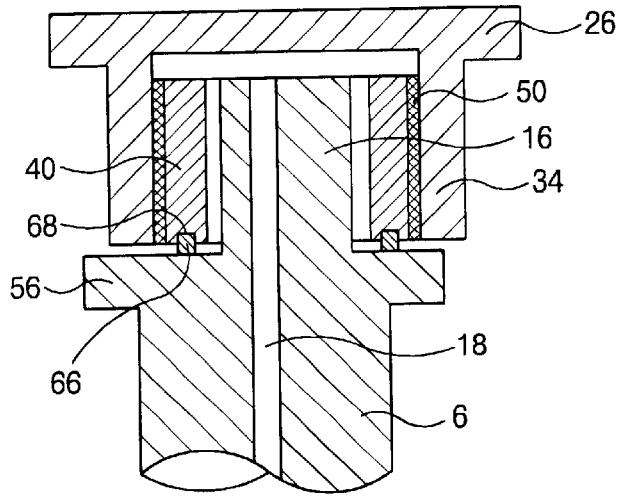
FIG. 9 illustrates a magnified cross-sectional view of a part 'B' on FIG. 3 according to a fifth embodiment of the present invention.

FIG. 9 illustrates a magnified cross-sectional view of a part 'B' on FIG. 3 according to a fifth embodiment of the present invention.

Referring to FIG. 9, a scroll compressor according to a fifth embodiment of the present invention includes a sealing member 66.installed between the flange unit 56 of the crankshaft 6 and the lower face of the compliance member 40 so as to prevent the oil flowing in the upper face of the eccentric part 16 through the oil flow path 18 from leaking in the back pressure chamber 38.

The sealing member 66 is preferably formed of a ring type Teflon based material. In order to load the sealing member 66, a fitting groove 68 is formed at the lower face of the compliance member 40 in a circumferential direction.

Figure 10:
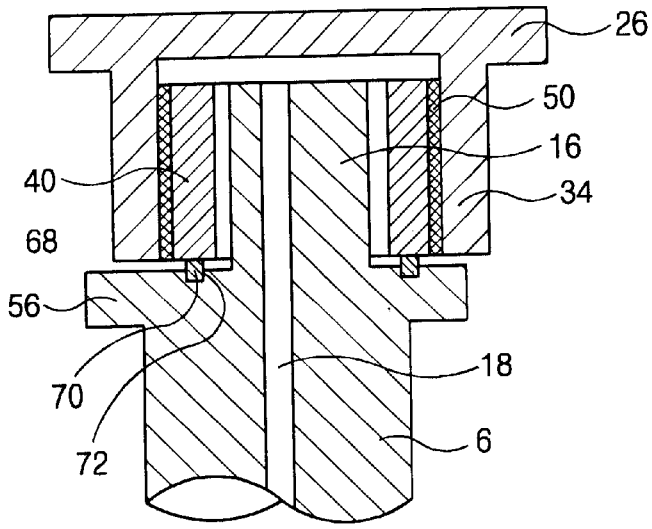
FIG. 10 illustrates a magnified cross-sectional view of a part 'B' on FIG. 3 according to a sixth embodiment of the present invention.

FIG. 10 illustrates a magnified cross-sectional view of a part 'B' on FIG. 3 according to a sixth embodiment of the present invention.

Referring to FIG. 10, a scroll compressor according to a sixth embodiment of the present invention includes a fitting groove 72 formed like a band in a circumferential direction of the upper face of the flange unit 56 of the crankshaft 6 and a sealing member 70 inserted in the fitting groove 72. And, the sealing member 70 is preferably formed of a ring type Teflon based material.

Figure 11:
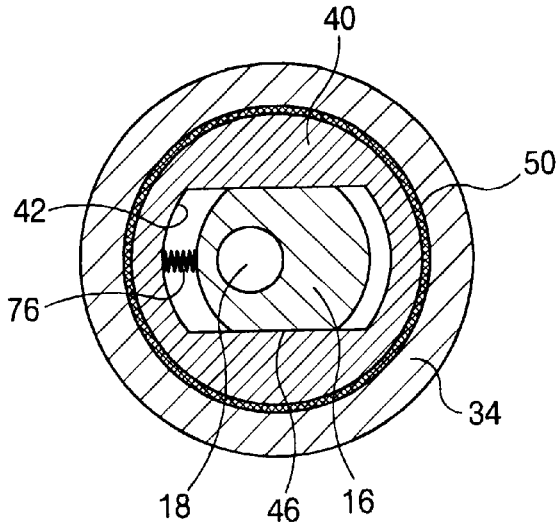
FIG. 11 illustrates a cross-sectional view along a cutting line II—II in FIG. 4 according to a seventh embodiment of the present invention.

FIG. 11 illustrates a cross-sectional view along a cutting line II—II in FIG. 4 according to a seventh embodiment of the present invention.

Referring to FIG. 11, in a scroll compressor according to a seventh embodiment of the present invention, an elastic body 76 is connected between the inner circumference face of the compliance member 40 and the outer circumference face of the eccentric part 16 of the crankshaft 6 so as to give an elastic force enabling the compliance member 40 to be restored to the original state after the sliding movement of the compliance member 40. And, the elastic body 76 is preferably made of a coil spring.

Figure 12:
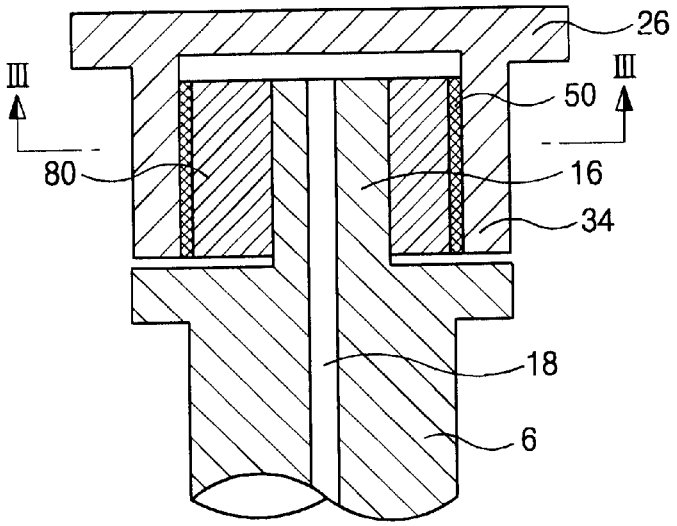
FIG. 12 illustrates a cross-sectional view along a cutting line II—II in FIG. 4 according to an eighth embodiment of the present invention.
Figure 13:
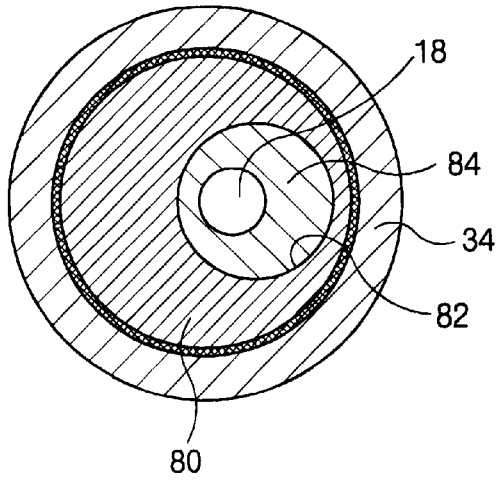
FIG. 13 illustrates a cross-sectional view along a cutting line III—III in FIG. 12 according to the eighth embodiment of the resent invention.

FIG. 12 illustrates a cross-sectional view along a cutting line II—II in FIG. 4 according to an eighth embodiment of the present invention, and FIG. 13 illustrates a cross-sectional view along a cutting line III—III in FIG. 12 according to the eighth embodiment of the present invention.

Referring to FIG. 12 and FIG. 13, a scroll compressor according to an eighth embodiment of the present invention includes a cylindrical compliance member 80 inserted in the boss 34 of the orbiting scroll 26 so as to revolve, an eccentric hole 82 formed to be eccentric from a center of the compliance member 80 in one direction, and a cylindrical eccentric part 84 inserted in the eccentric hole 82 so as to revolve.

In the above-constructed scroll compressor according to the eighth embodiment of the present invention, the crankshaft 6 revolves so that the eccentric part 84 revolves as being eccentric. Hence, the compliance member 80 revolves to make the orbiting scroll 26 circle round. In this case, if the orbiting scroll 26 retreats back in a radial direction, the compliance member 80 revolves round the eccentric hole 82 so as to move in a radial direction.

The above-constructed scroll compressor according to the present invention has the following effect or advantage.

The compliance member is installed between the eccentric part of the crankshaft and the boss of the orbiting scroll so as to enable the orbiting scroll to move in a radial direction. If the pressure inside the compressing chamber increases due to the inflow of the incompressible fluid such as a liquid refrigerant, oil or particles, the orbiting scroll retreats in a radial direction so as to cope with the volume variation of the compressing room actively. Therefore, the present invention enables to prevent the breakage of the orbiting and fixed wraps of the orbiting and fixed scrolls as well as improve a reliance of the compressor.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A scroll compressor comprising:

a casing having a high pressure inside;

a driving unit arranged at a lower side of the casing and connected to a crankshaft so as to generate a driving force;

a compressing unit having an orbiting scroll connected to the crankshaft eccentrically and a fixed scroll so as to form a compressing chamber between the orbiting and fixed scrolls;

compliance means for retreating the orbiting scroll in a radial direction when an incompressible material flows in the compressing chamber, the compliance means installed between the compressing unit and the crankshaft, the compliance means comprising a compliance member inserted in an inner circumference face of a boss formed at a lower face of the orbiting scroll so as to revolve; and a seal ring installed between an outer circumference face of the compliance member and the inner circumference face of the boss of the orbiting scroll.

2. The scroll compressor of claim 1, wherein an oil flow path is formed to penetrate the crankshaft in a length direction and an eccentric part is formed at an upper side of the crankshaft so a to have a cross-sectional area smaller than that of the crankshaft.

3. The scroll compressor of claim 2, wherein a slot penetrates a center of the compliance member, and the eccentric part of the crankshaft is inserted in the slot so as to slide to move.

4. The scroll compressor of claim 3, wherein a cross-sectional area of the crankshaft is equal to an outer diameter area of the compliance member.

5. The scroll compressor of claim 3, wherein a flange unit protrudes from an upper face of the crankshaft to a predetermined width in an external direction.

6. The scroll compressor of claim 3, wherein a rib is formed in an outer circumferential direction of a lower face of the compliance member so as to adhere closely to an upper face of the crankshaft.

7. The scroll compressor of claim 3, wherein a rib is formed in an inner circumferential direction of a lower face of the compliance member so as to adhere closely to an upper face of the crankshaft.

8. The scroll compressor of claim 2, wherein the eccentric part extends from an upper side of the crankshaft so as to form a predetermined step part and has a straight portion provided by cutting both sides of the eccentric part in a length direction.

9. The scroll compressor of claim 8, wherein the slot is formed to have a predetermined length in a long direction so that the straight portion of the eccentric part is inserted in the slot to slide and the eccentric part slides to move in a radial direction to a predetermined distance.

10. The scroll compressor of claim 1, wherein the compliance means is a compliance member inserted in a boss formed at a lower face of the orbiting scroll to revolve and having an eccentric hole formed eccentric from a center so that an eccentric part of the crankshaft is inserted in the eccentric hole.

11. The scroll compressor of claim 10, wherein the eccentric part is cylindrical so as to extend from an upper face of the crankshaft.

12. The scroll compressor of claim 10, wherein the compliance member is cylindrical so as to be inserted in an inner circumference face of the boss and wherein an eccentric hole is formed at a location eccentric from a center of the compliance member to a predetermined extent.

13. A scroll compressor comprising:

a casing having a high pressure inside;

a driving unit arranged at a lower side of the casing and connected to a crankshaft so as to generate a driving force;

a compressing unit having an orbiting scroll connected to the crankshaft eccentrically and a fixed scroll so as to form a compressing chamber between the orbiting and fixed scrolls;

compliance means for retreating the orbiting scroll in a radial direction when an incompressible material flows in the compressing chamber, the compliance means installed between the compressing unit and the crankshaft;

wherein an oil flow path is formed to penetrate the crankshaft in a length direction and an eccentric part is formed at an upper side of the crankshaft so a to have a cross-sectional area smaller than that of the crankshaft;

wherein the compliance means is a compliance member inserted in an inner circumference face of a boss formed at a lower face of the orbiting scroll so as to revolve, a slot penetrates a center of the compliance member, and the eccentric part of the crankshaft is inserted in the slot so as to slide to move; and wherein a sealing member is inserted between a lower face of the compliance member and an upper face of the crankshaft.

14. The scroll compressor of claim 13, wherein a fitting groove is formed at the lower face of the compliance member in a circumferential direction so that the sealing member fits in the fitting groove.

15. The scroll compressor of claim 13, wherein a fitting groove is formed at the upper face of the crankshaft in a circumferential direction so that the sealing member fits in the fitting groove.

16. The scroll compressor of claim 13, wherein the sealing member is formed of a Teflon based material.

17. A scroll compressor comprising:

a casing having a high pressure inside;

a driving unit arranged at a lower side of the casing and connected to a crankshaft so as to generate a driving force;

a compressing unit having an orbiting scroll connected to the crankshaft eccentrically and a fixed scroll so as to form a compressing chamber between the orbiting and fixed scrolls;

compliance means for retreating the orbiting scroll in a radial direction when an incompressible material flows in the compressing chamber, the compliance means installed between the compressing unit and the crankshaft;

wherein an oil flow path is formed to penetrate the crankshaft in a length direction and an eccentric part is formed at an upper side of the crankshaft so a to have a cross-sectional area smaller than that of the crankshaft;

wherein the compliance means is a compliance member inserted in an inner circumference face of a boss formed at a lower face of the orbiting scroll so as to revolve, a slot penetrates a center of the compliance member, and the eccentric part of the crankshaft is inserted in the slot so as to slide to move; and wherein an elastic body is connected between an inner circumference face of the compliance member and an outer circumference face of the eccentric part of the crankshaft.

18. The scroll compressor of claim 17, wherein the elastic body is a coil spring.

19. A scroll compressor comprising:

a casing having a high pressure inside;

a driving unit arranged at a lower side of the casing and connected to a crankshaft so as to generate a driving force;

a compressing unit having an orbiting scroll connected to the crankshaft eccentrically and a fixed scroll so as to form a compressing chamber between the orbiting and fixed scrolls;

compliance means for retreating the orbiting scroll in a radial direction when an incompressible material flows in the compressing chamber, the compliance means installed between the compressing unit and the crankshaft;

wherein an oil flow path is formed to penetrate the crankshaft in a length direction and an eccentric part is formed at an upper side of the crankshaft so a to have a cross-sectional area smaller than that of the crankshaft;

wherein the compliance means is a compliance member inserted in an inner circumference face of a boss formed at a lower face of the orbiting scroll so as to revolve, a slot penetrates a center of the compliance member, and the eccentric part of the crankshaft is inserted in the slot so as to slide to move; and wherein the seal ring is installed between an outer circumference face of the compliance member and the inner circumference face of the boss of the orbiting scroll.

* * * * *